United States Patent [19]

Melchior

[11] 3,948,241

[45] Apr. 6, 1976

[54] LUBRICATING AND SEALING SYSTEM FOR INTERNAL COMBUSTION ENGINES

[76] Inventor: Frederick C. Melchior, Box 379, Warrenton, Va. 22186

[22] Filed: Aug. 2, 1973

[21] Appl. No.: 384,791

[52] U.S. Cl. ..... 123/190 C; 123/65 VA; 123/80 C; 123/190 CA

[51] Int. Cl.[2] ..... F01L 7/00

[58] Field of Search ..... 123/65 VA, 65 VS, 71 VA, 123/80 C, 188 C, 188 GCL, 190 CA, 190 C, 190 DL, 190 E, 196 V

[56] References Cited

UNITED STATES PATENTS

| | | | |
|---|---|---|---|
| 1,200,478 | 10/1916 | Frink | 123/80 C |
| 1,442,523 | 1/1923 | Goby | 123/190 C |
| 1,649,509 | 11/1927 | Charter | 123/190 CA |
| 1,677,460 | 7/1928 | Pope | 123/190 C |
| 1,859,199 | 5/1932 | Davidson et al. | 123/80 C |
| 1,899,217 | 2/1933 | Taylor et al. | 123/81 C |
| 1,941,402 | 12/1933 | Konstaninoff | 123/190 DL |
| 3,736,911 | 6/1973 | Melchior | 123/30 C |

FOREIGN PATENTS OR APPLICATIONS

| | | | |
|---|---|---|---|
| 310,467 | 2/1917 | Germany | 123/190 C |
| 515,504 | 5/1920 | France | 123/190 C |
| 715,447 | 12/1941 | Germany | 123/190 C |

*Primary Examiner*—Wendell E. Burns
*Assistant Examiner*—David D. Reynolds
*Attorney, Agent, or Firm*—Nichol M. Sandoe

[57] ABSTRACT

A lubrication and sealing system for the cylinder head of an internal combustion engine having a sleeve valve mounted for rotation therein, said sleeve valve having intake slots therethrough which register periodically, as the valve rotates, with air intake ports in the cylinder to permit air to enter the cylinder. The sleeve valve is provided with one or more helically shaped sealing rings carried in the wall of the valve facing the wall of the cylinder, which said rings, as the valve rotates, sweep the wall of the cylinder to circulate lubricant oil within the clearance space between the valve and the cylinder to thereby lubricate and seal the clearance space. The circulation of lubricant also has a beneficial cooling effect.

7 Claims, 5 Drawing Figures

LUBRICANT INLET
COOLANT INLET
TO OIL COOLER
20
33
32
12
31
19
32
31
38
26
23
41
40
39
42
22
35
27
42
21
35
25
2
2
13
47
43
44
24
49
47
34
36
36
34
14
14
15
3
3
17
14
17
18
16
11

LUBRICATING AND SEALING SYSTEM FOR INTERNAL COMBUSTION ENGINES

This invention relates to a lubrication and sealing system for the cylinder of an internal combustion engine, and in particular for the cylinder of a two cycle type internal combustion engine such as disclosed in my prior U.S. Pat. No. 3,736,911, dated June 5, 1973. In the engine disclosed therein, a cylindrical sleeve valve is mounted for rotation on the cylinder on an axis which coincides with the axis of the cylinder, and is provided with a plurality of intake slots which register periodically, as the valve rotates, with air intake ports in the cylinder to permit a charge of air to enter the cylinder. It is necessary, of course, to provide clearance between the cylindrical wall of the sleeve valve and the wall of the cylinder, and it is also necessary to lubricate and seal the clearance space against leakage due to the exceedingly high pressures developed within the cylinder, particularly toward the end of the compression stroke and the beginning of the power stroke of the piston.

It is an object of the present invention to provide means for lubricating and sealing the said clearance space, while at the same time preventing any appreciable flow of lubricant into the cylinder.

Other objects and advantages of the invention will appear hereinafter.

A preferred embodiment of the invention is shown in the accompanying drawings, in which, FIG. 1 is a vertical section through the cylinder of a one cylinder, two cycle Diesel type engine, taken on the line 1—1 of FIG. 2, the piston being shown in broken line in a position corresponding to the commencement of its compression stroke.

As previously noted, the invention relates to a further development of the engine disclosed in my prior U.S. Pat. No. 3,736,911, to which reference may be had with respect to those features of construction and operation not fully described herein.

Figure 1:
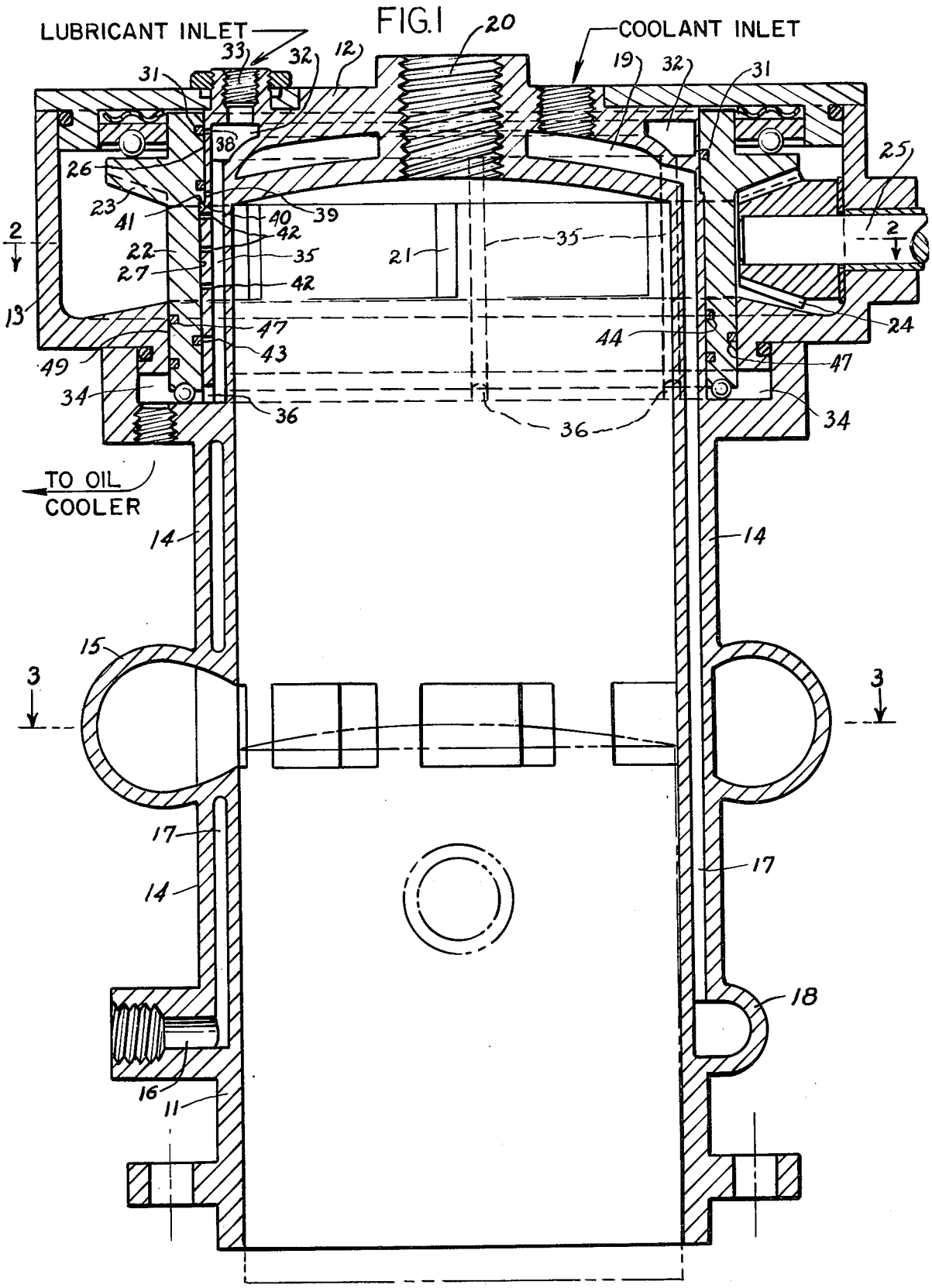
Figure 2:
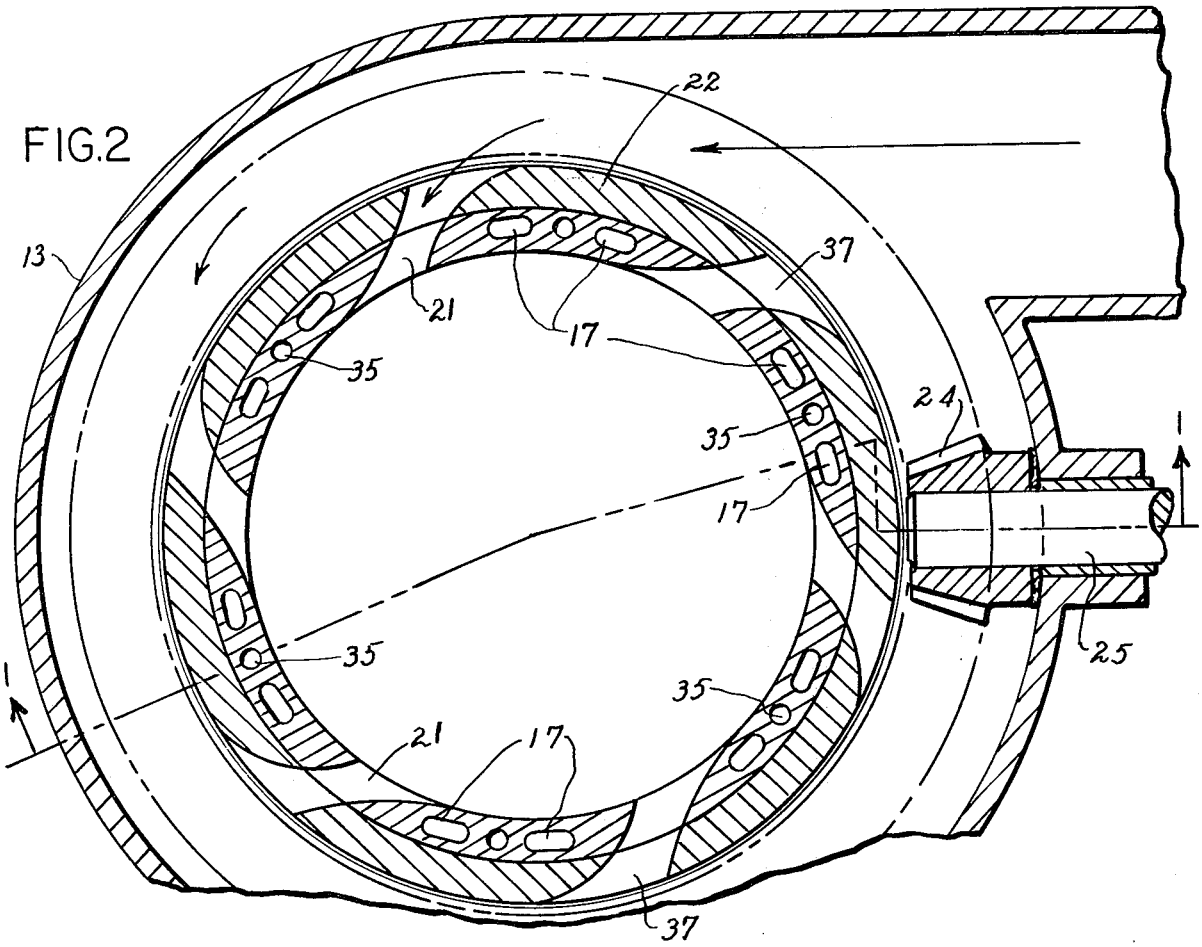
FIG. 2 is a section through the cylinder head on the line 2-2 of FIG. 1, with the rotating sleeve valve in position such that its inlet slots are in register with the inlet ports of the cylinder.
Figure 3:
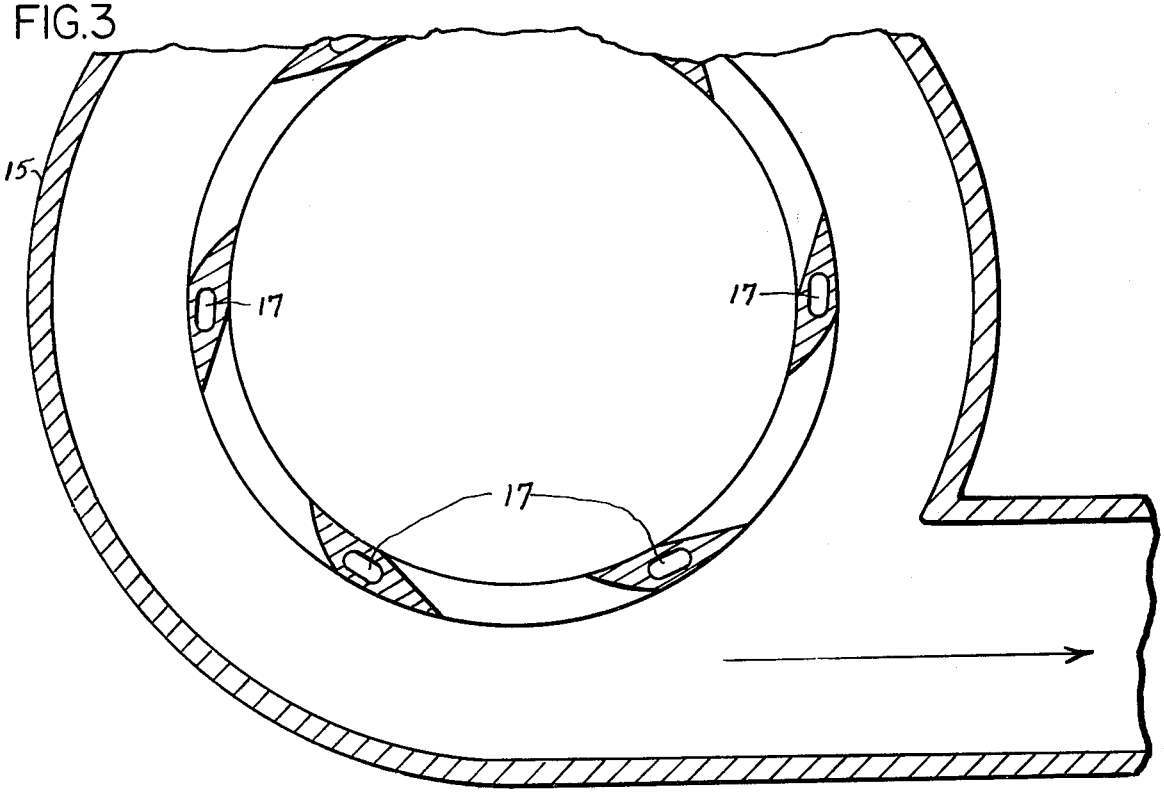
FIG. 3 is a section on the line 3—3 of FIG. 1.

Insofar as the present invention is concerned it is only necessary to identify certain parts of the engine previously disclosed in the patent such as the cylinder 11, the cylinder head 12, the air intake housing 13, the exhaust housing 15, the cooling jackets 14, the cooling chamber 19 in the cylinder head, the threaded aperture 20 to accommodate a fuel injection nozzle, the rotating sleeve valve 22 with its bevel ring gear 23 and bevel gear 24 mounted on an engine driven shaft 25. As described in the patent, the sleeve valve is provided with inlet slots 37 which register periodically, as the valve rotates, with intake ports 21 in the cylinder. As shown in FIGS. 1, 2 and 3 the cooling chamber 19 is in communication with vertical passages 17 in the cylinder wall so that coolant may flow from chamber 19, through passages 17 into the housing 18 from which it may exit through passage 16.

The present invention deals with the lubrication and sealing of the clearance spaces 26, 27 between the cylinder and the sleeve valve. It also deals with the sealing of the clearance space between the sleeve valve and the intake housing to prevent lubricant from escaping into the intake housing and thence into the cylinder.

Figure 4:
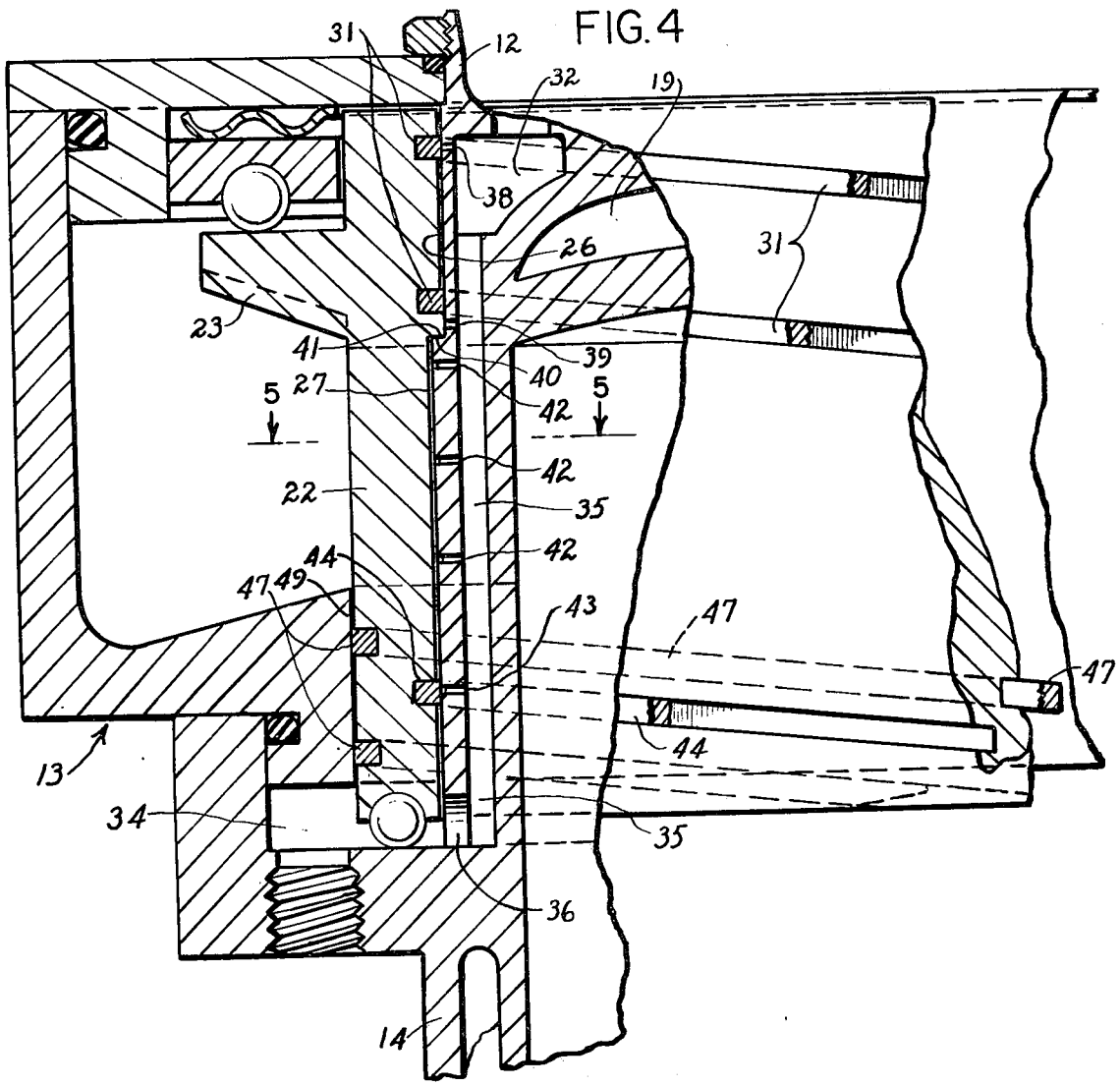
FIG. 4 is an enlarged detail section of the left hand side of the cylinder as it appears in FIG. 1, also taken on the line 1—1 of FIG. 2.

Referring now to FIGS. 1 and 4, the inside cylindrical wall of the sleeve valve 22 is provided with a helical groove in which is mounted a helical sealing ring 31 which is similar to and performs a function similar to that of the conventional piston rings of an internal combustion engine except that it is in helical form which enables it, as the sleeve valve rotates, to wipe downwardly across the opposed wall of the cylinder to force lubricant in the clearance space therebetween to move downwardly.

Lubricating oil is supplied to the annular oil reservoir 32, through a threaded aperture 33 to which a suitable inlet conduit (leading to an oil reservoir) may be connected. The reservoir 32 is connected to a sump 34 by a plurality of vertical passages 35 in the cylinder wall, each of said vertical passages being connected to said sump by an aperture 36. At the bottom of the sump is a threaded aperture to which a suitable outlet conduit leading to a pump returning the oil to the oil reservoir 32 may be connected, thereby providing a closed circuit for the circulation of lubricating oil. If desired, an oil cooler may be interposed in the circuit.

As the sleeve rotates, oil in the reservoir 32 will pass through the wall of the cylinder into the clearance space 26 through a series of apertures 38 located immediately below the level of the highest point reached by the helical ring as it rotates with the sleeve valve. Excess oil wiped downwardly by the helical ring 31 will be returned to the vertical passages 35 through apertures 39.

Figure 5:
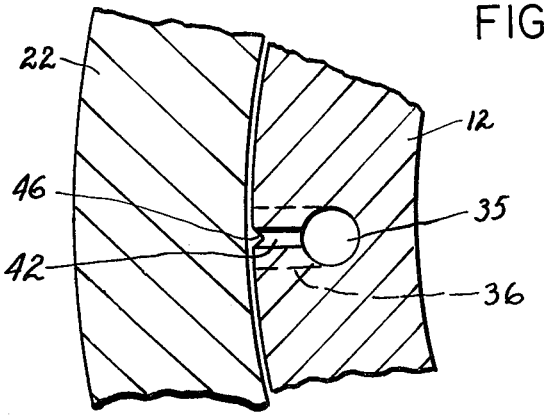
FIG. 5 is a further enlarged detail section on the line 5—5 of FIG. 4.

Immediately below the apertures 39 the wall of the cylinder is provided with an outwardly extending shoulder 40 which lies beneath and is in close contact with an inwardly extending shoulder 41 of the sleeve valve, thus minimizing direct flow of lubricant oil from the clearance space 26 into the clearance space 27. Flow of oil from the passages 35 into the clearance space 27 is admitted, however, by a series of small apertures 42. The aperture 43 is located immediately below the highest point reached by a helical ring 44 mounted in a helical groove in the inside wall of the sleeve. The downward wiping of the ring 44 as the sleeve rotates returns excess oil from the clearance space 27 and the aperture 43 to the sump 34. Small vertical grooves 46 (FIG. 5) communicate with the aperture 42 to permit minute quantities of lubricant to move vertically to insure adequate lubrication within all portions of the clearance space 27.

A third helical ring 47 mounted in helical groove in the outside wall of the sleeve valve extends across the clearance space between the valve and the housing and wipes the cylindrical wall 49 at the base of the intake housing 13. The downward wiping of the helical ring 47 as the sleeve rotates prevents lubricant oil from rising into the intake housing and thence into the cylinder.

It will be understood that the basic principles of the invention are applicable, not only to a two cycle Diesel type engine such as specifically disclosed herein using only the heat of compression for ignition, but are also applicable to other types of internal combustion engines in which a rotary sleeve valve may be used, as for example, semi-Diesel or hybrid types of engines in which mixed fuel and air fed to the cylinder and electrical ignition is used when the end pressure in the cylinder is insufficient for compression ignition.

What is claimed is:

1. An internal combustion engine comprising a piston and cylinder, said cylinder having a plurality of intake ports extending through the wall near the upper end thereof, said ports being spaced at intervals around the circumference of the cylinder, a cylindrical sleeve surrounding the outside wall of said cylinder with a cylindrical clearance space therebetween, means for mounting said sleeve valve for rotation with respect to said cylinder, said sleeve valve having a plurality of intake slots extending therethrough which register periodically with said intake ports as said sleeve valve rotates, and means for lubricating and sealing the portion of said clearance space above said intake ports, said means including a helically shaped ring mounted in a helical groove in the inside wall of said sleeve valve near the upper end of said valve with the lower ends of said ring and groove terminating above said intake ports and extending across said clearance space above said intake ports to wipe only the portion of the opposed surface of the cylinder above said intake ports as said sleeve valve rotates.

2. Apparatus as set forth in claim 1 in which said cylinder is provided with an oil reservoir in the wall thereof and apertures through the wall connecting said reservoir to said clearance space.

3. Apparatus as set forth in claim 2 in which the wall of said cylinder is provided with a plurality of vertical passages, the upper ends of which open into said reservoir, and in which said apertures extend laterally to connect said vertical passages with said clearance space.

4. Apparatus as set forth in claim 3 in which said vertical passages extend below the lower rim of said sleeve valve and open into a sump.

5. Apparatus as claimed in claim 1 including separate means for lubricating and sealing the portion of said clearance space below said intake ports, said means including a second helically shaped ring mounted in a helical groove in the inside wall of said sleeve valve near the lower end of said valve with the upper ends of said ring and groove terminating below said intake ports and extending across said clearance space below said intake ports to wipe only the portion of the opposed surface of the cylinder below said intake ports as the sleeve valve rotates.

6. Apparatus as claimed in claim 1 in which said engine includes an air intake housing surrounding said sleeve valve with a clearance space between the housing and the outside wall of said sleeve valve, and a helically shaped ring mounted in a helical groove in the outside wall of said sleeve valve and extending across said clearance space to wipe the opposed surface of the housing as the sleeve valve rotates.

7. Apparatus as claimed in claim 5 in which said cylindrical clearance space comprises two sections of different diameter separated by opposed interengaging shoulders on the cylinder and the sleeve valve, respectively, which minimize flow of lubricant from one of said sections to the other.

* * * * *